United States Patent [19]

Cheng

[11] Patent Number: 4,862,525

[45] Date of Patent: Sep. 5, 1989

[54] LAVATORY SEAT CONTROLLER

[76] Inventor: Chen H. Cheng, No. 16, Ming Hsiang Eight St., Hwa Lien City, Taiwan

[21] Appl. No.: 204,128

[22] Filed: Jun. 9, 1988

[51] Int. Cl.[4] ..... A47K 13/10

[52] U.S. Cl. ..... 4/251

[58] Field of Search ..... 4/241, 248, 251, 253, 4/236, 237, 240, 250, 308

[56] References Cited

U.S. PATENT DOCUMENTS

| | | | |
|---|---|---|---|
| 1,509,242 | 9/1924 | Kuno | 4/251 |
| 1,792,811 | 2/1931 | Bustin | 4/251 |
| 1,877,083 | 9/1932 | Thrasher | 4/251 |
| 2,155,548 | 4/1939 | Hompesch | 4/251 |

FOREIGN PATENT DOCUMENTS

| | | | |
|---|---|---|---|
| 498990 | 11/1954 | Italy | 4/251 |
| 550359 | 10/1956 | Italy | 4/251 |
| 218161 | 7/1924 | United Kingdom | 4/251 |

*Primary Examiner*—Henry J. Recla
*Assistant Examiner*—Glenn T. Barrett
*Attorney, Agent, or Firm*—Morton J. Rosenberg

[57] ABSTRACT

A lavatory seat controller which makes use of a lever by pressing on a pedal coupled to a lavatory seat lifting pedal rod to drive a straight push rod to rotate through a predetermined angle to lift the lavatory seat. The seat is lowered by pressing on the lavatory seat drawback pedal rod to drive a stop block connected thereto and thereby to push a Y-shaped guide rod and to further push the lavatory seat lifting pedal rod upward and to cause the straight push rod to move downward so as to rotate the L-shaped operating lever backward through the predetermined angle to draw back the lavatory seat.

3 Claims, 5 Drawing Sheets

LAVATORY SEAT CONTROLLER

BACKGROUND OF THE INVENTION

The present invention relates to a lavatory seat controller which makes use of a lavatory seat lifting pedal rod to cooperate with the motion of an operating lever to simply and cleanly control the lifting or draw-back of the lavatory seat.

The conventional lavatory seat is usually operated by hand, the operation of which does not meet the sanitary requirements of most people. Further, after having been used, the lavatory seat is not lifted immediately to keep the seat in a clean and sanitary condition. More particularly the public toilet is a bore to use because the lavatory seat is not lifted whenever used and it is more often dirty and unsanitary.

In view of the problems mentioned above that are encountered in conventional lavatory seat, the present invention is created with main object to provide a structure of lavatory seat lifting device by means of the arrangement to place a lavatory seat lifting pedal rod and a toilet seat draw-back pedal rod laterally by the lavatory seat at a proper position to match with a push rod and an operating lever so as to lift or draw back the lavatory seat to protect the lavatory seat in a clean and sanitary condition.

SUMMARY OF THE INVENTION

The present invention relates to a lavatory seat controller which makes use of a lever motion by means of pressing on a pedal coupled to a lavatory seat lifting pedal rod to drive a straight push rod to rotate through a predetermined angle to lift the lavatory seat. The seat is lowered by pressing on the lavatory seat drawback pedal rod to drive a stop block connected thereto and thereby to push a Y-shaped guide rod and to further push the lavatory seat lifting pedal rod upward and to cause the straight push rod to move downward so as to rotate the L-shaped operating lever backward through the predetermined angle to draw back the lavatory seat. The compact design of the present invention allows location in close proximity to the lavatory bowl to reduce the space required, to not interfere with the use of the lavatory, and to keep the lavatory seat in a clean and sanitary condition.

Parts quoted:

(1) L-shaped operating lever, (10) Base of lavatory seat, (11) Bolt hole, (12) Bolt, (13) Bolt hole, (14) Clamping plate. (2) Straight push rod, (21) Forked channel, (22) Bolt, (23) Forked channel. (3) Shock absorber spring, (31) Protective bushing. (4) Lavatory seat lifting pedal rod. (5) Support frame. (6) Y-shaped guide rod, (61) Return spring. (7) Lavatory seat draw-back pedal rod, (71) Stop block, (72) Mandrel (8) Grooved clamping body, (81) protruding elastic plate.

DESCRIPTION OF THE PREFERRED EMBODIMENTS

Figure 1:
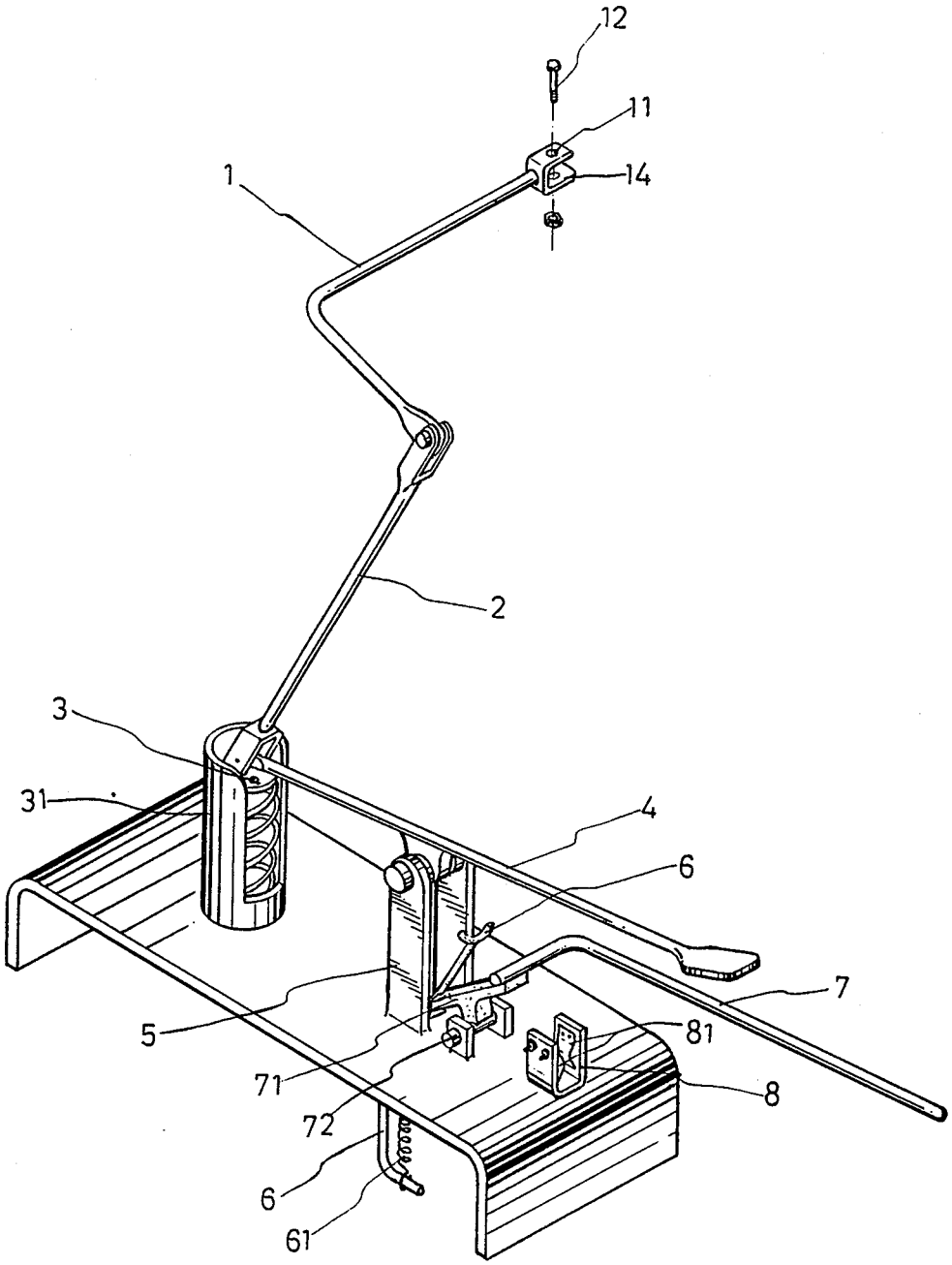
FIG. 1 is a structural perspective view of a lavatory seat controller embodying the present invention.

Please refer to the structural perspective view of the preferred embodiment according to the present invention as shown in FIG. 1 wherein the L-shaped operating lever 1 comprises a forked configuration at one end and with a straight push rod 2 pivotally connected at the other end. The push rod 2 is connected with a shock absorber spring 3 and a lavatory seat lifting pedal rod 4 at the bottom end; by means of a support frame 5 movably connected with said lavatory seat lifting pedal rod 4 at a proper position around the central part of the pedal rod 4 to provide a lever motion such that by means of pressing on the lavatory seat lifting pedal rod 4 to simply lift up the lavatory seat.

A Y-shaped guide rod 6 is placed in said support frame 5 with a return spring 61 properly connected at its bottom end and with a stop block 71 properly connected at its front end so as to connect with a lavatory seat draw-back pedal rod 7 such that by means of pressing on the lavatory seat draw-back pedal rod 7 the lavatory seat can be simply drawn back to cover the lavatory bowl after use.

Figure 2:
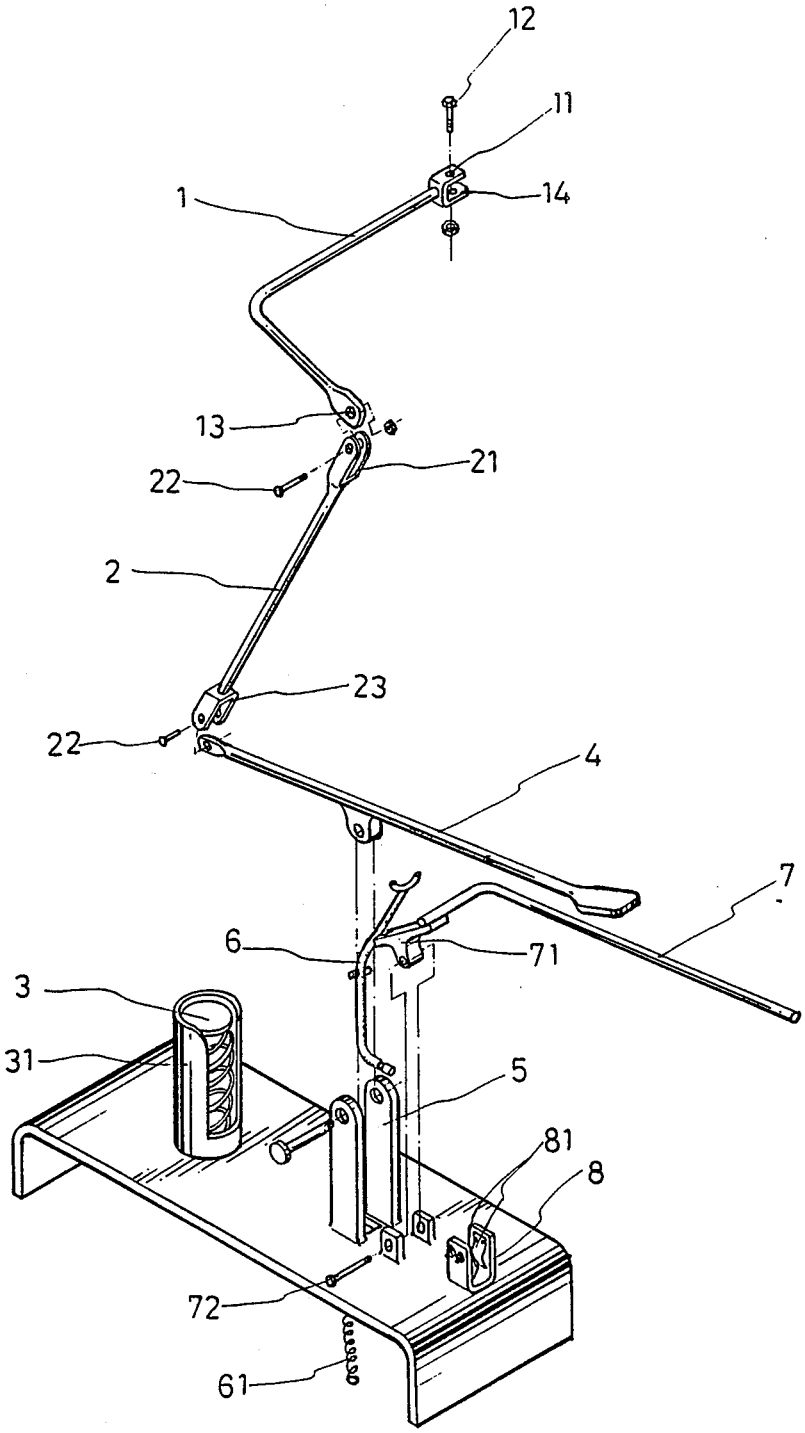
FIG. 2 is a fragmentary perspective view of the structure of the preferred embodiment according to the present invention.

Please refer to the fragmentary view of the preferred embodiment as shown in FIG. 2, wherein the L-shaped operating lever 1 comprises a forked body at the front end. The forked body has a central bolt hole 11 for the fixation of the operating lever 1 with the lavatory seat at the base 10 by means of a bolt 12. The rear end of the operating lever 1 is a flat configuration with a bolt hole 13 provided for pivotal connection with the straight rod 2 at the forked channel 21 by means of a bolt 22. The straight push rod 2 also has another forked channel 23 at the other end for pivotal connection with a lavatory seat lifting pedal rod 4 and a shock absorber spring 3. The shock absorber spring 3 is confined by a protective bushing 30 and may be of compression or expansion coil spring construction; and the lavatory seat lifting pedal rod 4 is supported at the center by a support frame 5 by means of a pivotal joint. Thus, by means of the operation of a mechanical lever motion, the lavatory seat can be simply lifted. A grooved clamping body 8 is arranged at the front of said support frame 5 with an elastic plate 81 respectively attached to each inner wall of the grooved clamping body 8 for allocation of the lavatory seat lifting pedal rod 4 at time the pedal rod 4 is pressed downward.

A Y-shaped guide rod 6 is placed in the support frame 5 with a return spring 61 properly connected at its bottom end and with a stop block 71 properly connected at its front end. The return spring 61 may be of compression or expansion coil spring construction. The stop block is pivotally connected thereto by means of a mandrel 72 with its front end adapted to stop the middle part of the guide rod 6 so as to provide a lever motion for operation. The rear end of the stop block 71 is connected with a lavatory seat draw-back pedal rod 7 such that by means of pressing on the lavatory seat draw-back pedal rod 7 the lavatory seat can be simply drawn back to cover the lavatory bowl after use.

Figure 3:
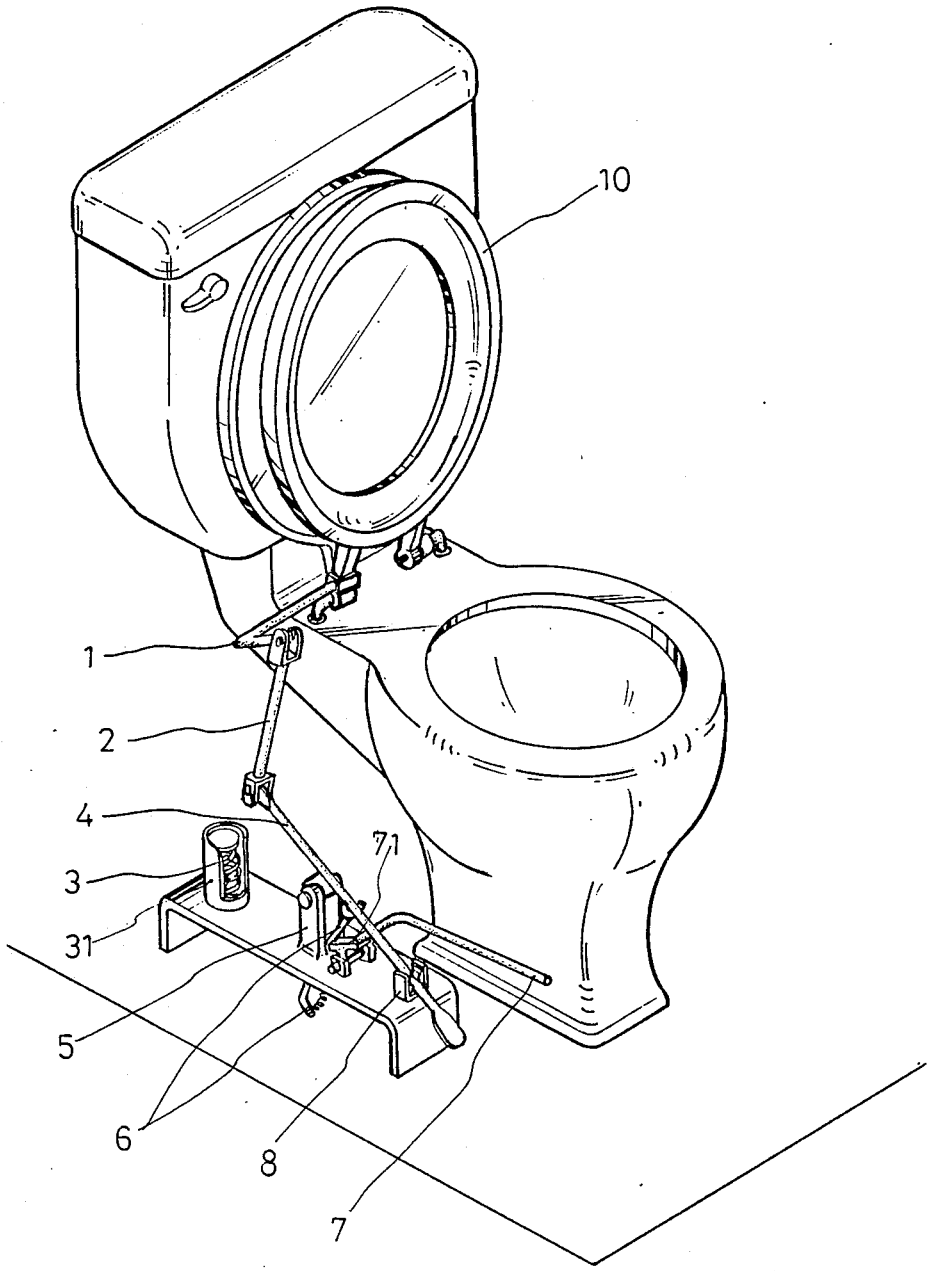
FIG. 3 is a perspective view of the lavatory seat controller when the seal is in an open or up position.

With respect to the operation of the preferred embodiment, please refer to FIGS. 2 and 3 for the lifting of the lavatory seat. When it is desired to lift the lavatory seat, pressure is applied to the rear end of the lavatory seat lifting pedal rod 4, letting the lifting pedal rod 4 be retained by the grooved clamping body by means of the two protruding elastic plates 81 and the Y-shaped guide rod 6, which will be pressed down by the pedal rod 4, at the time. The support frame is used as a point of support about which lifting pedal rod 4 rotates to provide a lever motion. The straight push rod 2 pivotally connected at the front end of the lavatory seat lifting pedal rod 4 is driven to move upward to be in vertical orientation and to pull the shock absorber spring therebeneath and to further drive the L-shaped operating lever 1 to rotate counterclockwise through an angle of approximately 90 degrees so as to lift the lavatory seat connected thereto upward to an angle of approximately 90 degrees, to complete the operation of lifting the lavatory seat.

Figure 4:
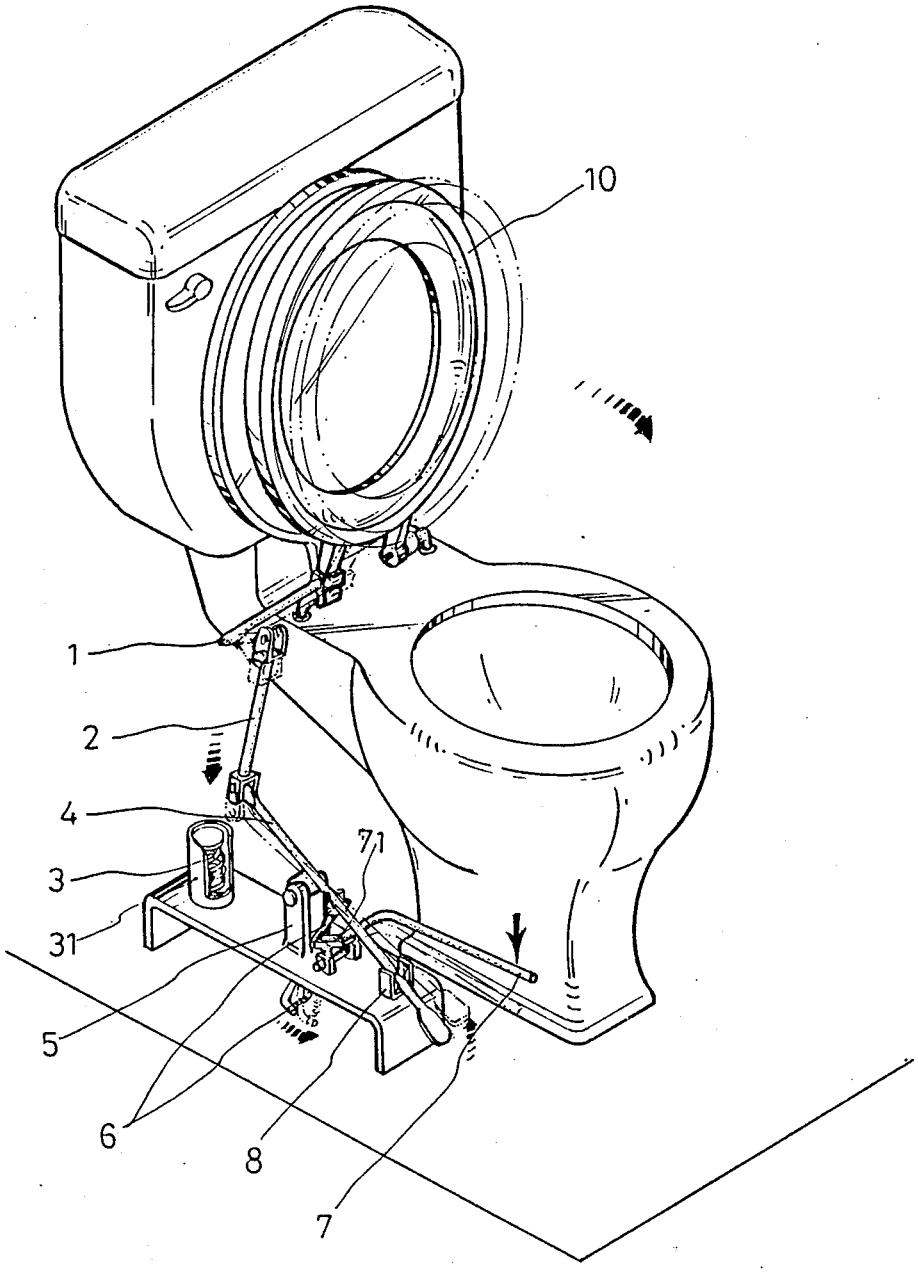
FIG. 4 illustrates the motion of the lavatory seat draw-back pedal rod of the preferred embodiment according to the present invention; and, FIG. 5 illustrates the application of the preferred embodiment according to the present invention.

As shown in FIG. 4, the operation to draw back the lavatory seat is performed by pressing down the rear end of the lavatory seat draw-back pedal rod 7, letting the front stop block 71 move upward to push the supported guide rod 6 to move upward so as to let the Y-shaped channel of the Y-shaped guide rod 6 stop the attached lavatory seat draw-back pedal rod 4 and make the lavatory seat draw-back pedal rod 4 break away from the two protruding elastic plates 81 of the grooved clamping body 8. At the same time, by means of the spring force of the shock absorber spring 3 to draw back the lavatory seat draw-back rod 4 and to drive the straight push rod 2 to move downward. Gravity causes a downward force on the base of lavatory seat, and thereby, the vertical push rod 2 is driven to incline backward position to make the L-shaped operating lever 1 rotate clockwise through an angle of approximately 90 degrees to draw back the connected lavatory seat to cover the lavatory bowl.

Figure 5:
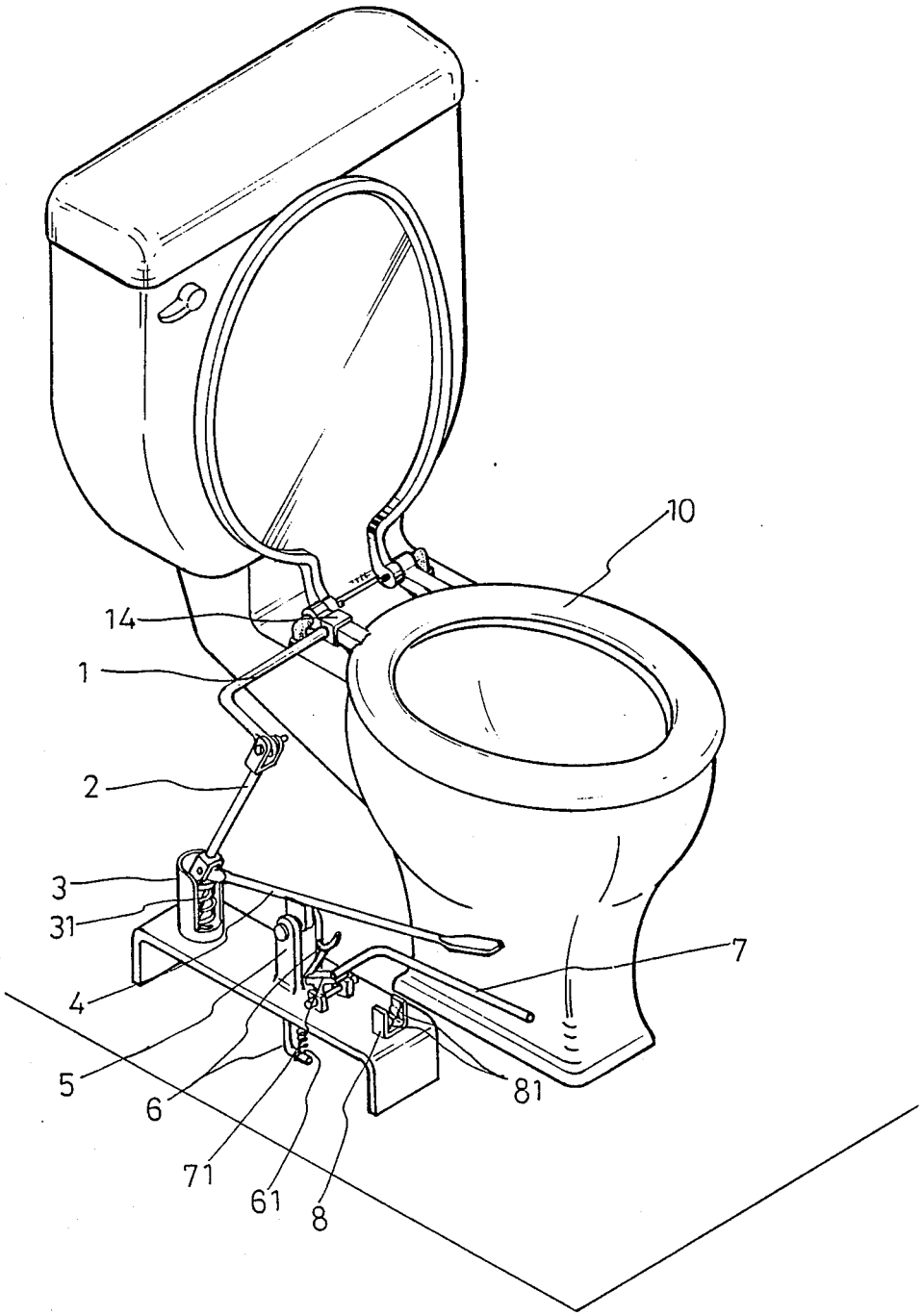

Please refer to FIG. 5 regarding to the application of the present preferred embodiment. The present preferred embodiment can be attached to a lavatory bowl in a way to fixedly connect the forked front end of the L-shaped operating lever 1 with the base of the lavatory seat 10 by means of bolt 12, shown in FIG. 1. The front end of the L-shaped operating lever 1 can also be designed to comprise two elastic clamping plates 14 for connection of the operating lever 1 with the base of the lavatory seat 10 by means of a clamp joint.

As described above, the lavatory seat controller of the present invention has been proved practical and is to make use of a mechanical lever motion through a driving mechanism to complete the operation, of which the operation is simple, the allocation of space small, and the result is to keep a clean and sanitary lavatory seat.

What is claimed is:

1. A lavatory seat controller, comprising:

an L-shaped operating lever having a forked first end having a bolt hole for coupling of said operating lever with lavatory seat base, said operating lever also having a bolt hole formed through an opposing second end;

a straight push rod with its upper end in a configuration of forked channel for pivotal coupling with said second end of said operating lever, said straight push rod having its bottom end in a forked channel configuration;

a lavatory seat lifting pedal rod having a first and second end with said first end pivotally coupled to said bottom end of said straight push rod at said forked channel, and with a shock absorber spring and a spring protective bushing arranged therebeneath;

a support frame pivotally coupled to said lavatory seat lifting pedal rod at a portion intermediate said first and second end of said lavatory seat lifting pedal rod, said support frame having a guide rod with a Y-shaped groove channel at one end and arranged in a central positional location of said support frame such that said Y-shaped groove channel of said guide rod is placed directly beneath the lavatory seat lifting pedal rod, said guide rod being coupled to a return spring extending between said guide rod and said support frame;

a lavatory seat draw-back pedal rod having a first end coupled to a rear end of a stop block, said stop block having a central portion pivotally coupled to said support frame, said stop block having front end positionally located in front of said guide rod for forming a stop for said guide rod;

a grooved clamping body disposed at a predetermined distance from said guide rod for holding said lavatory seat lifting pedal rod and having a pair of parallel walls, said clamping body including a protruding elastic plate located on an inner surface of each of said parallel walls;

whereby the above members form an easily operated lavatory seat controller so as to keep the lavatory seat in a clean and sanitary condition.

2. The lavatory seat controller as recited in claim 1 wherein said first end of said L-shaped operating lever includes a pair of elastic clamping plates for coupling said operating lever to said lavatory seat base.

3. The lavatory seat controller as recited in claim 1 wherein said shock absorber spring and said return spring are either of compression or expansion type coil spring configuration which can provide the same effect.

* * * * *